US007784176B2

(12) United States Patent
Yagi et al.

(10) Patent No.: US 7,784,176 B2
(45) Date of Patent: Aug. 31, 2010

(54) CRIMPING APPARATUS AND METAL TERMINAL

(75) Inventors: Satoshi Yagi, Makinohara (JP); Shigeharu Suzuki, Makinohara (JP); Tetsuro Ide, Makinohara (JP); Hideto Kumakura, Makinohara (JP); Kenji Suzuki, Makinohara (JP)

(73) Assignee: Yazaki Corporation, Tokyo (JP)

( * ) Notice: Subject to any disclaimer, the term of this patent is extended or adjusted under 35 U.S.C. 154(b) by 286 days.

(21) Appl. No.: 11/970,134

(22) Filed: Jan. 7, 2008

(65) Prior Publication Data

US 2008/0172866 A1 Jul. 24, 2008

(30) Foreign Application Priority Data

Jan. 18, 2007 (JP) ..... 2007-009132

(51) Int. Cl.
*H01R 43/042* (2006.01)

(52) U.S. Cl. ..... 29/753; 29/751; 29/761; 29/861; 29/863; 72/352; 72/370.12; 72/470

(58) Field of Classification Search ..... 29/751, 29/753, 761, 861, 863, 888.092; 72/371.12, 72/470, 352, 353.6; 76/30, 4, 107.1
See application file for complete search history.

(56) References Cited

U.S. PATENT DOCUMENTS 2,818,632 A * 1/1958 Hammell ..... 29/865
RE24,510 E * 8/1958 Macy ..... 439/877

FOREIGN PATENT DOCUMENTS

JP 61-48681 U 4/1986
JP 7-73950 A 3/1995

* cited by examiner

*Primary Examiner*—Derris H Banks
*Assistant Examiner*—Azm Parvez
(74) *Attorney, Agent, or Firm*—Sughrue Mion, PLLC

(57) ABSTRACT

A crimping apparatus includes an anvil for supporting a metal terminal including a base plate portion for mounting an electric wire thereon and a pair of crimping piece portions extending upwardly respectively from opposite side edges of the base plate portion and a crimper which includes a groove portion being opposed to a supporting portion of the anvil. An inner surface of the groove portion of the anvil and a terminal support face of the supporting portion of the crimper cooperate to press the crimping piece portions for crimping the crimping piece portions to the electric wire mounted on the metal terminal. A width of the groove portion of the crimper is not more than 1.0 mm. The terminal support surface of the anvil is formed into a concavely curved surface in which a depth of the concavely curved surface is not smaller than 0.06 mm and is not larger than 0.17 mm in a cross-section of the anvil perpendicular to an axis direction of the electric wire.

1 Claim, 6 Drawing Sheets

CRIMPING APPARATUS AND METAL TERMINAL

BACKGROUND

This invention relates to a crimping apparatus for crimping a metal terminal to an electric wire and also to a metal terminal crimped to an electric wire by the crimping apparatus.

FIG. 6 shows one known conventional crimping apparatus. A metal terminal 107 includes a pair of crimping piece portions 108 and 109 extending upwardly respectively from opposite side edges of a base plate portion on which an electric wire 106 is adapted to be placed. One crimping piece portion 109 is longer than the other crimping piece portion 108. A crimper 101 of the crimping apparatus for crimping the metal terminal 107 to the electric wire 106 has a notched groove 102, and introduction guide portions 103, pressing portions 104 and a curved portion 105 are formed on an inner surface of the notched groove 102 (see, for example, JP-A-7-73950).

The pair of crimping piece portions 108 and 109 are press-fastened (press-deformed) by the crimper 101 of the above construction in such a manner that the one crimping piece portion 109 overlaps the other crimping piece portion 108, and further a distal end portion of the crimping piece portion 108 is curved and deformed in a direction opposite to the press-fastening direction, and is engaged with an inner surface of the crimping piece portion 109.

FIG. 7 shows another known conventional crimping apparatus. Two arch-shaped portions arranged symmetrically with respect to a plane in adjoining relation are formed on an inner surface 112 of a crimper 111 for press-fastening a pair of crimping piece portions 117 of a metal terminal 116 to an electric wire 115. Each arch-shaped portion is formed by an arc-shaped portion 113 with a radius R1 and an arc-shaped portion 114 with a radius R2, and centers of circles on which the arc-shaped portions 113 and 114 are disposed, respectively, lie on an imaginary straight line A passing through an apex of the arch-shaped portion (see, for example, JP-UM-A-61-48681).

In each of JP-A-7-73950 and JP-UM-A-61-48681, an attempt has been made to improve the shape of the crimper so as to enhance electrical and mechanical performances of the crimped portion. However, when trying to change the shape of a crimper, the crimper tends to be formed into a complicated shape as in the crimper 101 of JP-A-7-73950 and the crimper 111 of JP-UM-A-61-48681, and there are fears that the time and labor required for producing the crimper may increase and that it may be difficult to maintain its processing precision.

Furthermore, in JP-A-7-73950, the press-fastened crimping piece portions 108 and 109 assume a complicated shape, and there is a fear that an increased load is applied to the crimping piece portions 108 and 109 during the press-fastening operation, and there is a fear that problems such as insufficient strength of the press-fastened crimping piece portions 108 and 109, the separation of a plating layer, etc., may be encountered.

In connection with the design of a connector and a metal terminal, many limitations are imposed on a crimper which is a main factor in the definition of the shape of the crimped metal terminal. For example, in the case where the metal terminal is crimped to a very thin electric wire with a core wire having a cross-sectional area of not more than 0.13 $mm^2$, a width of a groove in the crimper is usually limited to not more than 1.0 mm, and this groove width can not be freely increased, and the conventional techniques for improving the shape of the crimper can not always deal with this situation.

SUMMARY

This invention has been made in view of the above circumstances, and an object of the invention is to provide a crimping apparatus and a wire-connected metal terminal capable of securing good electrical and mechanical performances of a crimped portion.

The above object has been achieved by a crimping apparatus of the following Paragraphs (1) and (2) and also by a wire-connected metal terminal of the following Paragraphs (3) and (4).

(1) A crimping apparatus comprising:

an anvil for supporting a metal terminal including a base plate portion for mounting an electric wire thereon and a pair of crimping piece portions extending upwardly respectively from opposite side edges of the base plate portion; and a crimper which includes a groove portion being opposed to a supporting portion of the anvil, wherein an inner surface of the groove portion of the crimper and a terminal support face of the supporting portion of the anvil cooperate to press the crimping piece portions for crimping the crimping piece portions to the electric wire mounted on the metal terminal;

wherein a width of the groove portion of the crimper is not more than 1.0 mm; and wherein the terminal support surface of the anvil is formed into a concavely curved surface in which a depth of the concavely curved surface is not smaller than 0.06 mm and is not larger than 0.17 mm in a cross-section of the anvil perpendicular to an axis direction of the electric wire.

(2) The crimping apparatus according to Paragraph (1), wherein the pair of crimping piece portions are crimped to the electric wire made of a copper alloy and having a cross-sectional area of 0.08 $mm^2$ to 0.13 $mm^2$.

(3) A metal terminal, comprising:

a base plate portion on which an electric wire is mounted; and a pair of crimping piece portions which crimp the electric wire, wherein a bottom surface of the base plate portion is formed into a convexly curved surface in which a width of the convexly curved surface is not more than 1.0 mm, and a height of the convexly curved surface is not smaller than 0.06 mm and is not larger than 0.17 mm in a cross-section of the metal terminal perpendicular to an axis direction of the electric wire.

(4) The metal terminal according to Paragraph (3), wherein the electric wire is made of a copper alloy and has a cross-sectional area of 0.08 $mm^2$ to 0.13 $mm^2$.

In the invention, the terminal support surface of the anvil is formed into the concavely curved surface assuming the generally arc-shaped contour in the cross-section of the anvil disposed perpendicular to the axis of the electric wire, and the depth of the concavely-curved surface is not smaller than 0.06 mm and is not larger than 0.17 mm. By thus determining the shape of the anvil which is simpler and less limited in shape than the crimper, problems such as the increase of the time and labor for the production, the difficulty in maintaining processing precision, etc., can be avoided, and electrical and mechanical performances of the crimped portion can be secured. The crimping apparatus of the invention is particularly suited for use with the very thin electric wire with the core wire having the cross-sectional area of not more than 0.13 $mm^2$, in which case the width of the groove in the crimper is limited to not more than 1.0 mm.

In the metal terminal having the electric wire, the bottom surface of the base plate portion for contact with the terminal support surface of the anvil is formed into the convexly-curved surface assuming the generally arc-shaped contour in the cross-section perpendicular to the axis of the electric wire, and the width of the convexly-curved surface is not more than 1.0 mm, and the height of the convexly-curved surface is not smaller than 0.06 mm and is not larger than 0.17 mm, and with this construction the electrical and mechanical performances of the crimped portion are secured.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF EXEMPLARY EMBODIMENTS

A preferred embodiment of the present invention will now be described with reference to the drawings.

Figure 1:
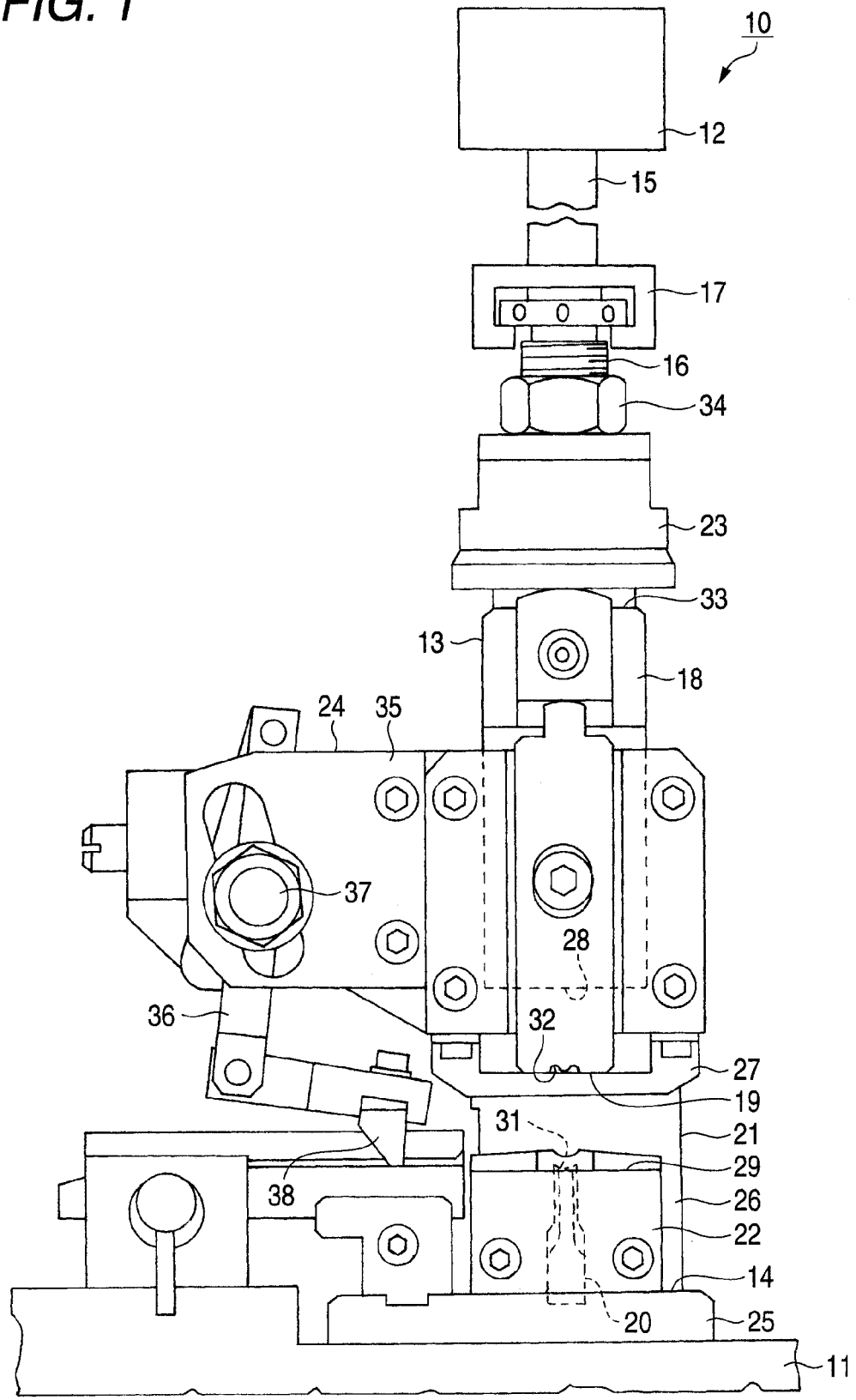
FIG. 1 is a front-elevational view of one preferred embodiment of a crimping apparatus of the present invention.
Figure 2:
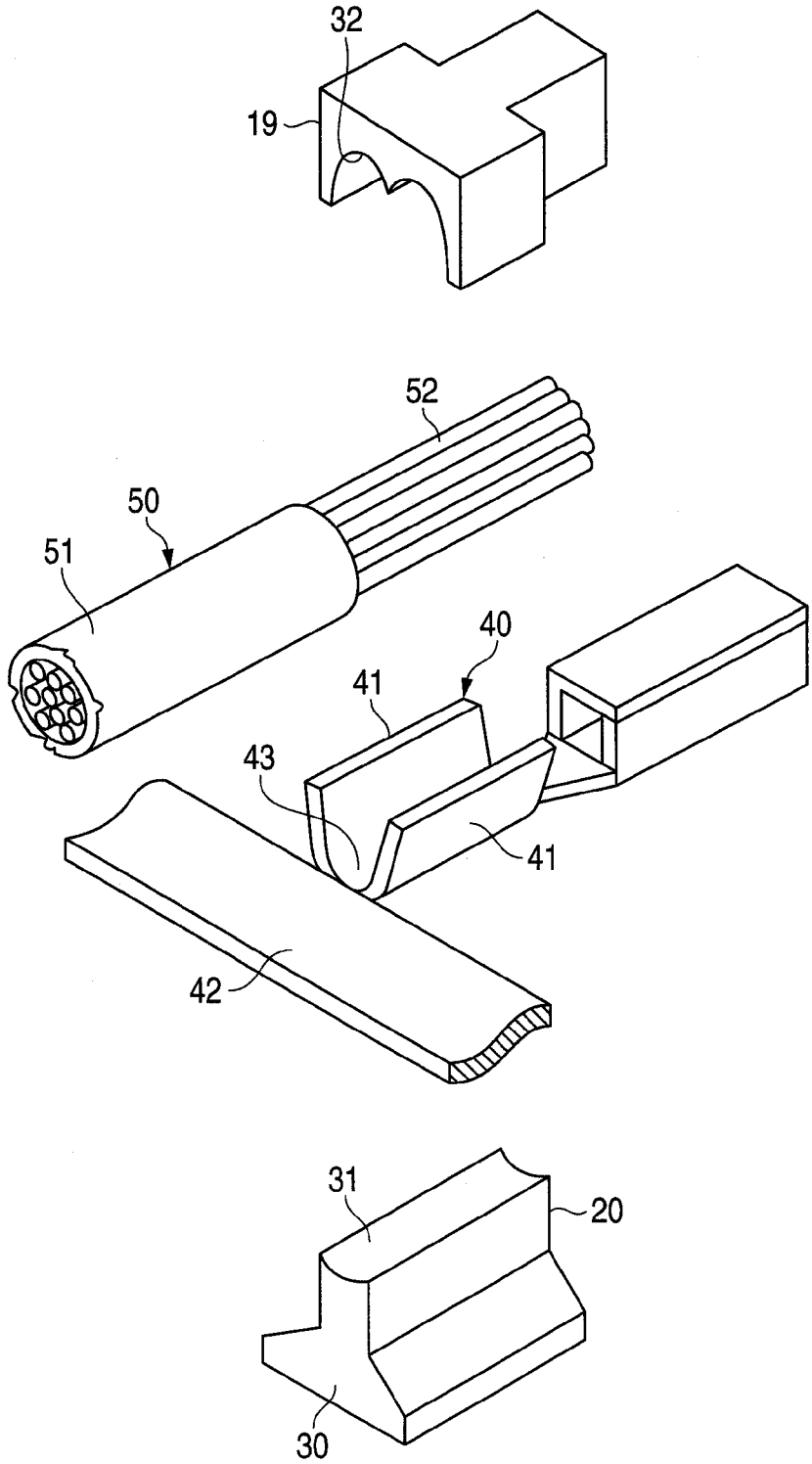
FIG. 2 is a perspective view showing a crimper and an anvil used in the crimping apparatus of FIG. 1, an electric wire and a metal terminal to be crimped to the electric wire by the crimper and the anvil.
Figure 3:
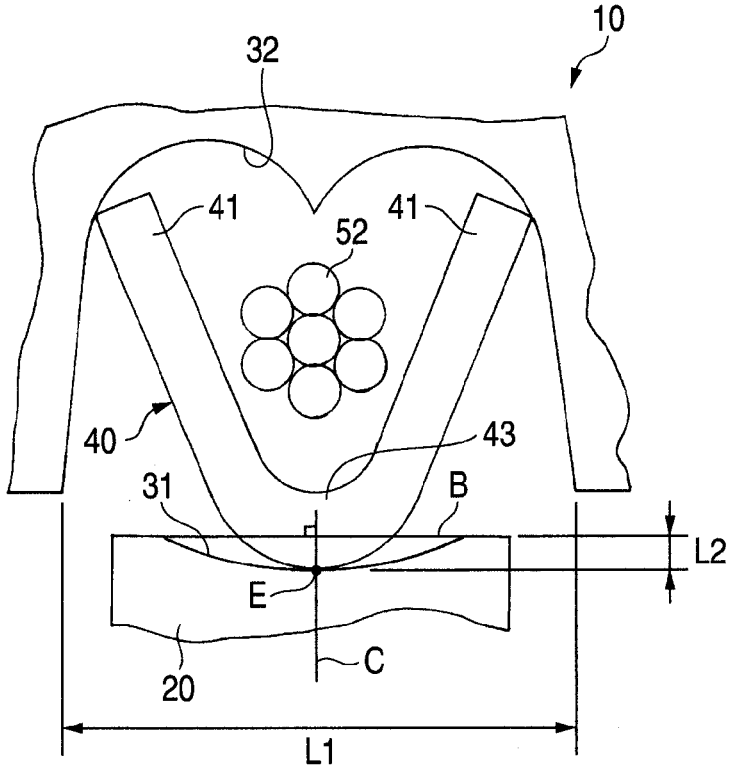
FIG. 3 is an enlarged front-elevational view showing the crimper, the anvil, the electric wire and the metal terminal of FIG. 2 during a crimping operation.

As shown in FIGS. 1 and 2, the crimping apparatus 10 of this embodiment comprises a base 11 placed on a floor or the like, a drive source 12, and a crimping applicator 13 for crimping the metal terminal 40 to the electric wire 50.

The base 11 has a flat portion 14 which is generally flat in a horizontal direction. The crimping applicator 13 is placed and supported on the base 11.

The drive source 12 comprises a servomotor (not shown), a drive shaft 15 for transmitting a driving force, and a hook 17 engaged with a disk portion (not shown) of a shank 16. A rotational motion of the servomotor is converted into a linear motion via a piston-crank mechanism so as to move a ram 18 upward and downward. Instead of the servomotor, a hydraulic cylinder having a piston rod connected to the shank 16 in directly-driving relation or other suitable drive unit may be used.

The crimping applicator 13 includes the crimper 19, and the anvil 20. The crimper 19 is moved downward to press-fasten crimping piece portions 41 of the metal terminal 40 to the electric wire 50, thereby crimping the metal terminal 40 to the electric wire 50.

Various forms of metal terminals can be used as the metal terminal 40 in so far as such metal terminal has a pair of crimping piece portions to be press-fastened to a core wire of the electric wire. For example, a female metal terminal having a box-like electrical contact portion, a male terminal having a tab-like electrical contact portion, a joint metal terminal for connecting two wires together, etc., can be used.

The metal terminal 40 is formed by forming an electrically-conductive sheet into a predetermined shape by blanking and then by bending it. A plurality of metal terminals 40 are interconnected at equal intervals at their one ends (in a cantilever manner) by a strip-like carrier 42, and are fed in this chain-like form to the crimping applicator 13.

The pair of crimping piece portions 41 of the metal are deformed inwardly by the downward movement of the crimper 19, and are press-fastened to the core wire 52, thereby crimping the metal terminal 40 to the electric wire 50. A rotational motion of the servomotor is converted into a linear motion by the piston-crank mechanism so as to move the ram 18 (holding the crimper 19) upward and downward, thereby moving the crimper 19 upward and downward.

The crimping applicator 13 comprises a frame 21, a holder 22 holding the anvil 20, the ram 18 supported on the frame 21, a ram bolt 23 threadedly engaged with the ram 18 so as to enable the upward and downward movement of the ram 18, the shank 16 threadedly engaged with the ram bolt 23, and a terminal feed unit 24.

The frame 21, when viewed from the side thereof, has a generally recumbent U-shape, and includes a mounting portion 25 on which the holder 22 is mounted, an upwardly-extending support post portion 26, and a ram support portion 27. The frame 21 is placed on the flat portion 14 of the base 11, and is fixed thereto to bolts and nuts (not shown). The frame 21 may be integrally fixed to the base 11.

The ram support portion 27 is connected to an upper end portion of the support post portion 26 extending upwardly from the mounting portion 25 on which the holder 22 is mounted. A space for guiding the ram 18 is formed in the ram support portion 27, and the ram 18 is slidably fitted in this space.

The anvil 20 for the placing of the metal terminal 40 thereon is embedded in the holder 22. The holder 22 has a flat surface 29 opposed to both of the crimper 19 and a lower end surface 28 of the ram 18.

The anvil 20 is received and held in the holder 22, and in this condition the holder 22 is mounted on the mounting portion 25 of the frame 21. The anvil 20 is held in the holder 22, with its bottom plate 30 disposed in intimate contact with a bottom wall of the holder 22, and therefore the anvil 20 can support the metal terminal 40 thereon without being shaken.

The ram 18 has a generally rectangular parallelepiped shape. The ram 18 is supported in the ram support portion 27 so as to move upward and downward in the vertical direction. A longitudinal axis of the ram 18 extends in the direction of movement thereof, that is, in the vertical direction. The lower end surface 28 of the ram 18 is flat, and is perpendicular to the direction of movement of the ram 18.

The crimper 19 is provided at a lower half portion of the ram 18 in opposed relation to the anvil 20. The crimper 19 is in the form of a generally rectangular parallelepiped-shaped plate, and a groove 32 of a generally arch-shape is formed at that surface of the crimper 19 opposed to the anvil 20. When the crimper 19 is moved downward, an upper portion of the anvil 20 is received in the groove 32. An inner surface of the groove 32 is formed into such a curved shape as to press-deform (press-fasten) the crimping piece portions 41 of the metal terminal 40 into a predetermined shape.

The ram bolt 23 is threaded into a threaded hole formed in an upper end surface 33 of the ram 18, and therefore is mounted on the ram 18. By thus mounting the ram bolt 23 on the ram 18, the ram 18 can be moved upward and downward.

The shank 16 has a hollow cylindrical shape. The disk portion formed at one end of the shank 16 is connected to the hook 17 of the drive source 12, and a screw portion formed at the other end of the shank 16 is threaded in a screw hole in the ram bolt 23. Namely, the shank 16 transmits a driving force of the drive source 12 to the ram 18 via the ram bolt 23 so as to move the crimper 19 upward and downward.

The amount of threading of the shank 16 in the screw hole of the ram bolt 23 can be adjusted, and therefore the shank 16 is mounted on the ram bolt 23 in such a manner that the position of the shank 16 relative to the ram bolt 23 can be changed. When the position of the shank 16 relative to the ram bolt 23 is changed by adjusting the amount of threading of the shank 16 in the screw hole of the ram bolt 23, the distance (gap) between the anvil 20 and the crimper 19 is also changed.

The shank 16 has a nut 34 threaded on an externally-threaded portion thereof, and the nut 34 is tightened, with the shank 16 threaded in the screw hole of the ram bolt 23, and by doing so, the ram bolt 23 and the shank 16 can be fixed to each other.

The terminal feed unit 24 comprises a cam (not shown) provided at a side portion of the ram 18, a connecting rod (not shown) adapted to abut against the cam to be moved in the horizontal direction, a lever support portion 35 receiving the connecting rod therein, a crank-like lever 36 fitted in the lever support portion 35, a pivot shaft 37 supporting the lever 36 in a manner to allow a pivotal movement of the lever 36, and a terminal feed claw 38 provided at a distal end portion of the lever 36.

In the terminal feed unit 24, the cam is moved downward by the driving force of the drive source 12, and at this time the connecting rod abuts at its one end against the cam, and is pushed to be moved in the horizontal direction, so that the other end portion of the connecting rod is brought into abutting engagement with the lever 36, and the lever 36 is pivotally moved about the pivot shaft 37. As a result, the terminal feed claw 38 is engaged in a feed hole in the carrier 42, and moves the carrier 42 in a terminal feeding direction to feed one metal terminal at a time to a crimping position.

The core wire 52 of the electric wire 50 is composed of a plurality of wire elements twisted together. In the case where the cross-sectional area of the core wire 52 is not more than 0.13 $mm^2$, a width L1 of an opening of the groove 32 is usually limited to not more than 1.0 $mm^2$. The inner surface of the groove 32 extending from one end (or edge) of the opening to the other end thereof is formed by a pair of arch-shaped curved surfaces arranged symmetrically with respect to a plane in adjoining relation.

The upper portion of the anvil 20 has a width smaller than the width L1 of the opening of the groove 32 so that this upper portion can be inserted into the groove 32 when the crimper 19 is moved downward. The anvil 20 has a terminal support surface 31 on which a base plate portion 43 of the metal terminal 40 is adapted to be placed or supported. The terminal support surface 31 is formed into a concavely-curved surface having a depth L2 of from 0.06 mm to 0.17 mm (that is, not smaller than 0.06 mm and not larger than 0.17 mm) and assuming a generally arc-shaped contour in a cross-section of the anvil 20 disposed perpendicular to an axis of the core wire 52 of the electric wire 50. Here, the depth L2 means the distance from a line B interconnecting opposite ends of the arc-shaped contour of the terminal support surface 31 (in the above cross-section) to a point E of intersection of a perpendicular bisector C of the line B with the terminal support surface 31. A plurality of serrations are formed in the terminal support surface 31 at predetermined intervals, and extend in the direction of the axis of the core wire 52.

When the crimper 19 is moved downward, the metal terminal 40 placed on the terminal support surface 31 of the anvil 20 is inserted into the groove 32 of the crimper 19, and the arch-shaped curved surfaces defining the inner surface of the groove 32 are brought into abutting engagement with the pair of crimping piece portions 41, respectively. The metal terminal 40 is pressed between the crimper 19 and the anvil 20, and the pair of crimping piece portions 41 slide respectively on the arch-shaped curved surfaces (forming the inner surface of the groove 32), and are bent inwardly to be press-fastened to the core wire 52.

Figure 4:
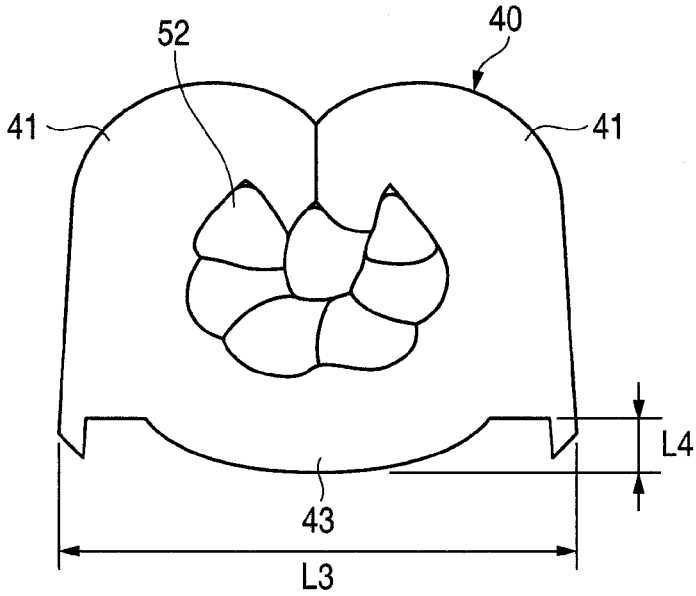
FIG. 4 is an enlarged front-elevational view of the metal terminal of FIG. 2 crimped to the electric wire.

In the metal terminal 40 press-fastened to the core wire 52, the pair of crimping piece portions 41 are press-fastened uniformly to the core wire 52 as shown in FIG. 4, and a bottom surface of the base plate portion 43 is formed into a convexly-curved surface having a width L3 of not more than 1.0 mm and a height L4 of from 0.06 mm to 0.17 mm and assuming a generally arc-shaped contour in a cross-section perpendicular to the axis of the core wire 52.

EXAMPLE

Next, description will be made of Example of the invention conducted in order to confirm advantageous effects of the crimping apparatus 10 of the invention In the Example, a crimping operation was effected using an anvil with a terminal support surface having a depth of 0.13 mm. In Comparative Example 1, a crimping operation was effected using an anvil with a terminal support surface having a depth of 0.05 mm. In Comparative Example 2, a crimping operation was effected using an anvil with a terminal support surface having a depth of 0.20 mm. Then, a force (strength) of clamping of a metal terminal to an electric wire, a resistance (initial resistance) of a crimped portion immediately after the crimping operation and a resistance (endurance resistance) of the crimped portion a predetermined period of time after the crimping operation were measured. A core wire of the electric wire (to which a pair of crimping piece portions were press-fastened) was made of a copper alloy containing tin (Sn) (The Sn content: about 0.3%). A cross-sectional area of the core wire was 0.13 $mm^2$. In each of the Example and Comparative Examples 1 and 2, the above measurement was effected several times, and results thereof are shown in FIG. 5.

Figure 5:
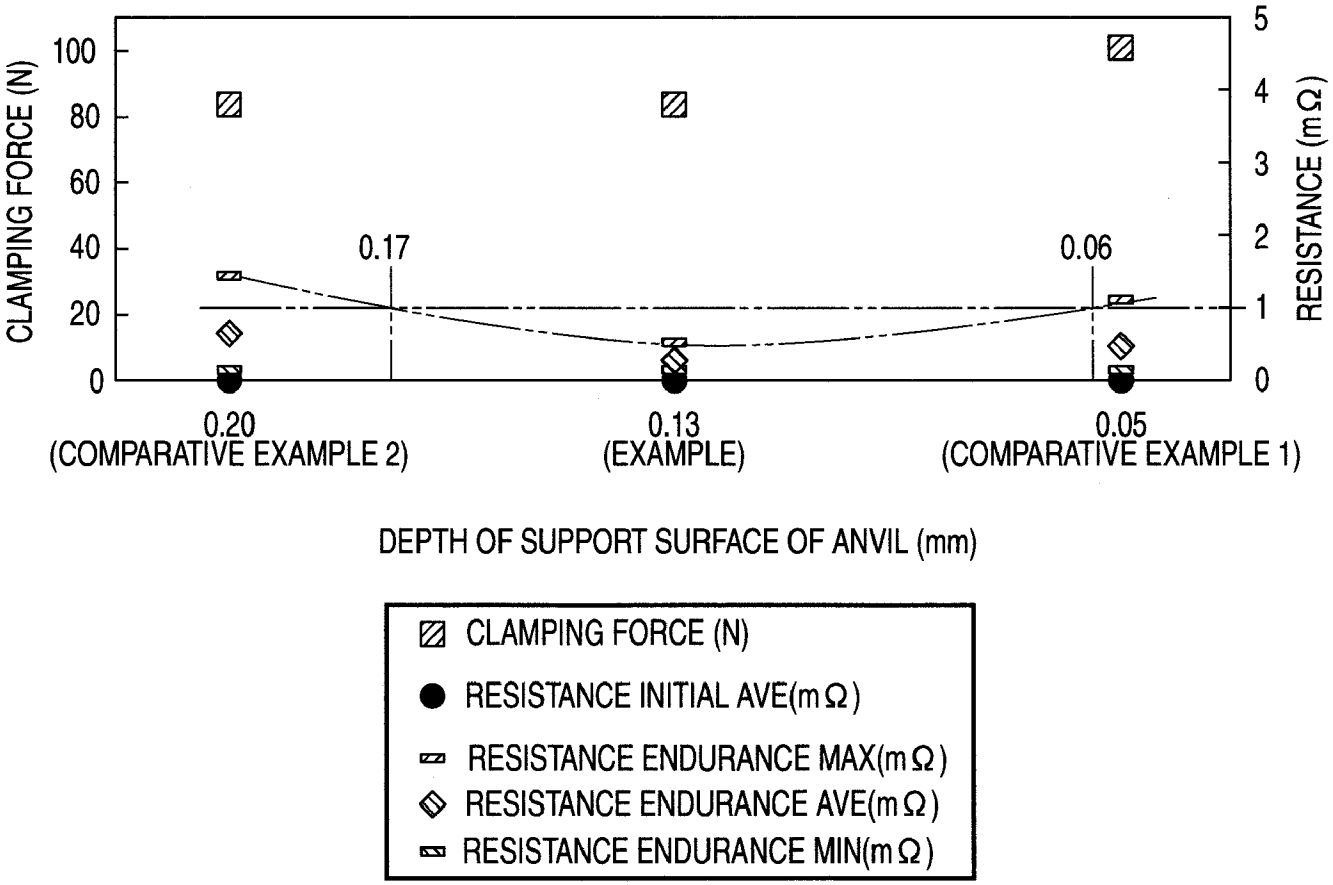
FIG. 5 is a graph showing measured values of a clamping force, an initial resistance and an endurance resistance of Example and Comparative Examples 1 and 2.
Figure 6:
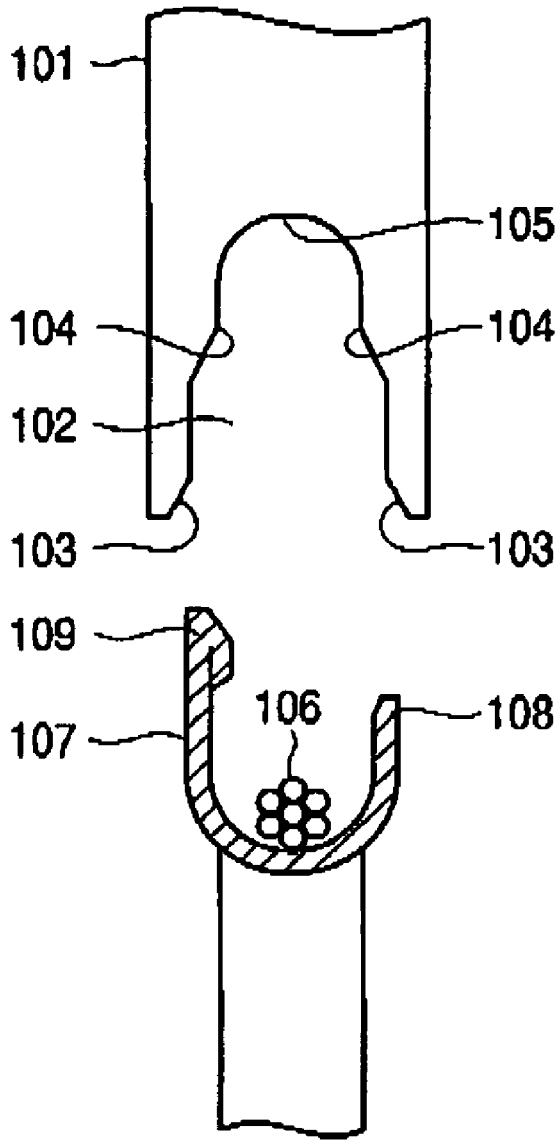
FIG. 6 PRIOR ART
FIG. 6 is a schematic view of a conventional crimping apparatus.
Figure 7:
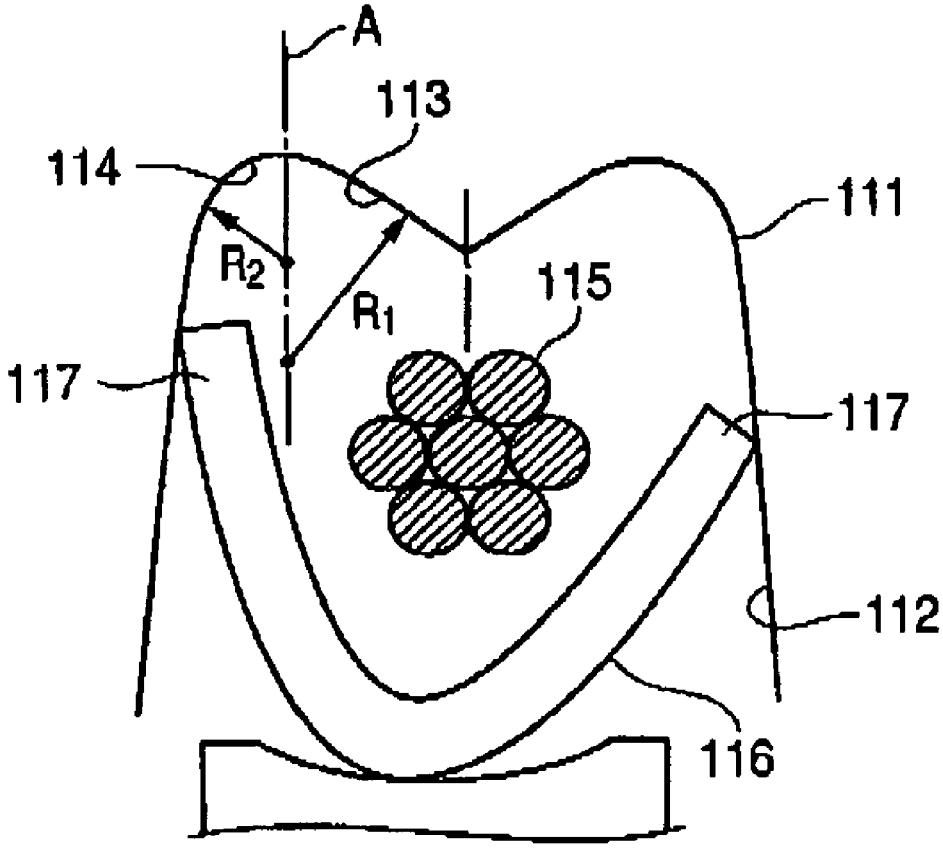
FIG. 7 PRIOR ART
FIG. 7 is a schematic view of another conventional crimping apparatus.

As is clear from FIG. 5, in the Comparative Example 1 in which the depth of the terminal support surface of the anvil is smaller as compared with the Example, a load per unit area is large since the terminal support surface is generally flattened and hence has a reduced area, and as result the clamping force is increased. However, when the terminal support surface of the anvil is thus flattened, a base plate portion of the crimped metal terminal is also flattened, and the area of contact of this base plate portion with the electric wire is reduced, and the initial resistance and the endurance resistance are both high.

In the Comparative Example 2 in which the depth of the terminal support surface of the anvil is larger as compared with the Example, a load per unit area is small since the terminal support surface has an increased area, and as result the clamping force is decreased. However, the area of contact of a base plate portion of the crimped metal terminal with the electric wire is increased, and therefore the initial resistance is low. However, an endurance resistance is higher as compared with the Example, and it is thought that this is due to the fact that spring back occurs in the crimping piece portions a predetermined period of time after the crimping operation.

On the other hand, in the Example in which the depth of the terminal support surface of the anvil is 0.13 mm, the clamping force, the initial resistance and the endurance resistance all exhibit well-balanced good values.

Here, let's assume that a practical allowable range (upper limit) of the endurance resistance is 1 mΩ, and in a curve obtained by interpolating points respectively representing the maximum values of the endurance resistances of the Example and the Comparative Examples 1 and 2, the depth of the terminal support surface of the anvil which satisfies the endurance resistance of not more than 1 mΩ is in the range of from 0.06 mm to 0.17 mm.

It will be appreciated from the foregoing that when the depth of the terminal support surface of the anvil is not smaller than 0.06 mm and is not larger than 0.17 mm, the crimping can be effected such that the clamping force, the initial resistance and the endurance resistance all exhibit well balanced good values. Incidentally, similar results were obtained with respect to electric wires each having a core wire having a cross-sectional area of 0.08 $mm^2$.

As described above, in this embodiment, by suitably determining the shape of the anvil 20 which is simpler and less limited in shape than the crimper 10, problems, such as the increase of the time and labor for the production, the difficulty in maintaining the processing precision, etc., can be avoided, and the electrical and mechanical performances of the crimped portion can be secured. The crimping apparatus of the invention is particularly suited for use with the very thin electric wire with the core wire 52 having the cross-sectional area of not more than 0.13 $mm^2$, in which case the width of the groove in the crimper 10 is limited to not more than 1.0 mm.

The present invention is not limited to the above embodiment, and modifications, improvements, etc., can be suitably made. Furthermore, the material, dimensions, numerical value, form, number, disposition, etc., of each of the constituent elements of the above embodiment are arbitrary, and are not limited in so far as the invention can be achieved.

The present application is based on Japan Patent Application No. 2007-009132 filed on Jan. 18, 2007, the contents of which are incorporated herein for reference.

What is claimed is:

1. A crimping apparatus, comprising:

an anvil for supporting a metal terminal including a base plate portion for mounting an electric wire thereon and a pair of crimping piece portions extending upwardly respectively from opposite side edges of the base plate portion; and a crimper which includes a groove portion being opposed to a supporting portion of the anvil, wherein an inner surface of the groove portion of the crimper and a terminal support face of the supporting portion of the anvil cooperate to press the crimping piece portions for crimping the crimping piece portions to the electric wire mounted on the metal terminal;

wherein a width of the groove portion of the crimper is not more than 1.0 mm;

wherein the terminal support surface of the anvil is formed into a concavely curved surface in which a depth of the concavely curved surface is not smaller than 0.06 mm and is not larger than 0.17 mm in a cross-section of the anvil perpendicular to an axis direction of the electric wire, and the pair of crimping piece portions are crimped to the electric wire made of a copper alloy and having a cross-sectional area of 0.08 $mm^2$ to 0.13 $mm^2$.

* * * * *